United States Patent [19]

Bassett

[11] Patent Number: 5,035,542

[45] **Date of Patent: * Jul. 30, 1991**

[54] APPARATUS AND METHOD FOR RELEASABLE CONNECTIONS

[76] Inventor: Max Bassett, 926 Coachlight Dr., #422, Houston, Tex. 77077

[ * ] Notice: The portion of the term of this patent subsequent to Sep. 19, 2006 has been disclaimed.

[21] Appl. No.: 207,289

[22] Filed: Jun. 15, 1988

Related U.S. Application Data

[63] Continuation-in-part of Ser. No. 147,976, Jan. 25, 1988, Pat. No. 4,867,612.

[51] Int. Cl.[5] ..... E02B 17/02

[52] U.S. Cl. ..... 405/227; 405/199

[58] Field of Search ..... 405/227, 195, 199, 196, 405/198, 203, 224

[56] References Cited

U.S. PATENT DOCUMENTS

| | | | |
|---|---|---|---|
| 2,873,580 | 2/1959 | Suderow | 405/199 |
| 2,934,804 | 5/1960 | Suderow . | |
| 2,944,403 | 7/1960 | Smith | 405/199 |
| 2,969,648 | 1/1961 | Rechtin | 405/199 X |
| 3,670,507 | 6/1972 | Mott et al. | 405/227 |
| 4,269,543 | 5/1981 | Goldman et al. | 405/198 |
| 4,337,010 | 6/1982 | Sullaway et al. | 405/227 |
| 4,398,847 | 8/1983 | Horowitz et al. | 405/199 |
| 4,479,401 | 10/1984 | Korkut | 405/198 X |
| 4,497,592 | 2/1985 | Lawson | 405/227 X |
| 4,867,612 | 9/1989 | Bassett | 405/227 |

FOREIGN PATENT DOCUMENTS 2372277 6/1978 France .

*Primary Examiner*—David H. Corbin
*Attorney, Agent, or Firm*—David Ostfeld

[57] ABSTRACT

An apparatus and method for releasably connecting an offshore structure to a piling is disclosed. After the tubular piling is installed through the leg of the structure, a piston drives a gripping plate toward the piling until the plate firmly grips the piling. A joint between the piston and the plate accommodates variable angles between the piston and the gripping plate. More than one piston can be associated with each plate, and more than one plate may be used to selectively position the piling relative to the structure. The pistons can be manipulated to retract the gripping plates so that the pilings can be withdrawn from the structure.

42 Claims, 3 Drawing Sheets

APPARATUS AND METHOD FOR RELEASABLE CONNECTIONS

This is a continuation-in-part of U.S. Patent Application Ser. No. 147,976, filed Jan. 25, 1988, now U.S. Pat. No. 4,867,612.

FIELD OF THE INVENTION

The present invention relates to an apparatus and method for connecting a structure to a fixed object such as a piling. More particularly, the present invention relates to an apparatus and method for connecting an offshore structure to a cylindrical piling anchored to the soil underlying a body of water.

BACKGROUND OF THE INVENTION

Offshore platforms are used in the drilling and production of oil, gas, and other hydrocarbons. To support the platform, pilings are driven into the soil underlying the body of water. The platform acts as a template to structurally interconnect the pilings and provides support for various equipment associated with the well. The platform typically consists of inclined main jacket legs, comparatively short satellite jacket legs, and cross braces which interconnect the legs. The main pilings generally extend upwardly from the soil and through the respective main platform legs. Satellite pilings typically extend from a point above the shorter jacket legs and down into the soil.

Static and dynamic axial, radial and rotational forces are transmitted from each piling to the surrounding leg, and from each leg to the interiorly positioned piling. The platform distributes loads from the main pilings to the satellite pilings and also distributes the other loads over each of the main pilings.

In order to provide the desired structural support between the pilings, it is essential that the platform legs be securely connected to the respective pilings. The desired structural connection is usually obtained by providing a pair of spaced inflatable members in the annulus between the piling and the platform leg. Concrete or other grouting material is then pumped into this annulus to connect the jacket leg to the piling. The cured grouting provides the necessary interconnection between the platform legs and the pilings to withstand the substantial axial, radial and rotational forces acting between the platform legs and the pilings.

In spite of the widespread acceptance of the above-described grouting technique, this procedure has significant drawbacks. The cylindrical-shaped pilings and external platform tubulars are rarely concentric, and it is difficult and expensive to ensure that grouting has adequately filled thinner annulus spacings between a platform leg and its eccentrically positioned piling. Most importantly, the grouting prevents the later separation of the subsea platform from its pilings during subsequent salvage operations after the economic life of the offshore wells served by the installation has been exhausted. While the pilings are metallic tubulars which can be cut below the sea bed mud line, the platform cannot thereafter be practically refloated to the surface because of the substantial weight which the pilings and the grouting add to the platform. As a consequence, platforms secured to pilings by the above-described grouting technique are customarily salvaged by cutting the platform into individual components which can be retrieved to the surface. This subsea disassembly of the platform is not only extremely expensive, but also substantially destroys the value of the platform for subsequent use.

Although grouting techniques are used in most petroleum recovery installations, platform legs have been mechanically connected to pilings by deformably expanding the piling radially outward until the piling contacts the platform legs. Equipment and techniques for radially expanding the pilings are marketed under the trade names "Lynes Corrigator" and "Hydrolock". This radial expansion technique is not widely accepted because of the expense and because the deformation of the piling inherently reduces the structural integrity of the piling. Moreover, this technique generally does not readily permit the retrieval of the platform, since the connection between the pilings and the platform legs cannot be practically disengaged.

Accordingly, a need exists for an apparatus and method for releasably connecting jacket legs of an offshore platform to pilings. The connection should be sufficiently secure to accommodate the large loading forces and should be readily detachable to permit recovery of the platform.

SUMMARY OF THE INVENTION

The present invention overcomes the disadvantages of the prior art by providing an apparatus and method for releasably connecting a structure to a piling. A gripping member for releasably engaging the piling is connected to a joint. A drive means is connected between the joint and the structure for urging the gripping member into engagement with the piling and for retracting the gripping member from engagement with the piling. The joint permits movement between the gripping member and the drive means as the drive means urges the gripping member toward the piling. In other embodiments of the invention, more than one drive means can be associated with a particular gripping member, and more than one gripping member can be used to selectively position the piling within the jacket leg.

The method of the invention is practiced by positioning the piling adjacent to the structure. Next, a drive means is manipulated to urge a joint and connected gripping member into engagement with the piling. Subsequently, the gripping member can be retracted from engagement with the piling to permit the withdrawal of the piling from the position adjacent to the structure.

DETAILED DESCRIPTION OF PREFERRED EMBODIMENTS

The present invention structurally connects a structure such as an offshore platform to pilings which are positioned adjacent to a platform tubular jacket leg. Typically, tubular pilings are installed through the legs of a jacket to anchor the platform to the sea bed. In one embodiment of the invention, the connectors are utilized in a subsea environment. The techniques of the present invention enable the platform to be economically secured to the piling, so that the jacket legs can be released from the piling. Substantial savings can be realized when utilizing the connectors of the present invention, since the platform can be retrieved to the surface and can be reused.

Figure 1:
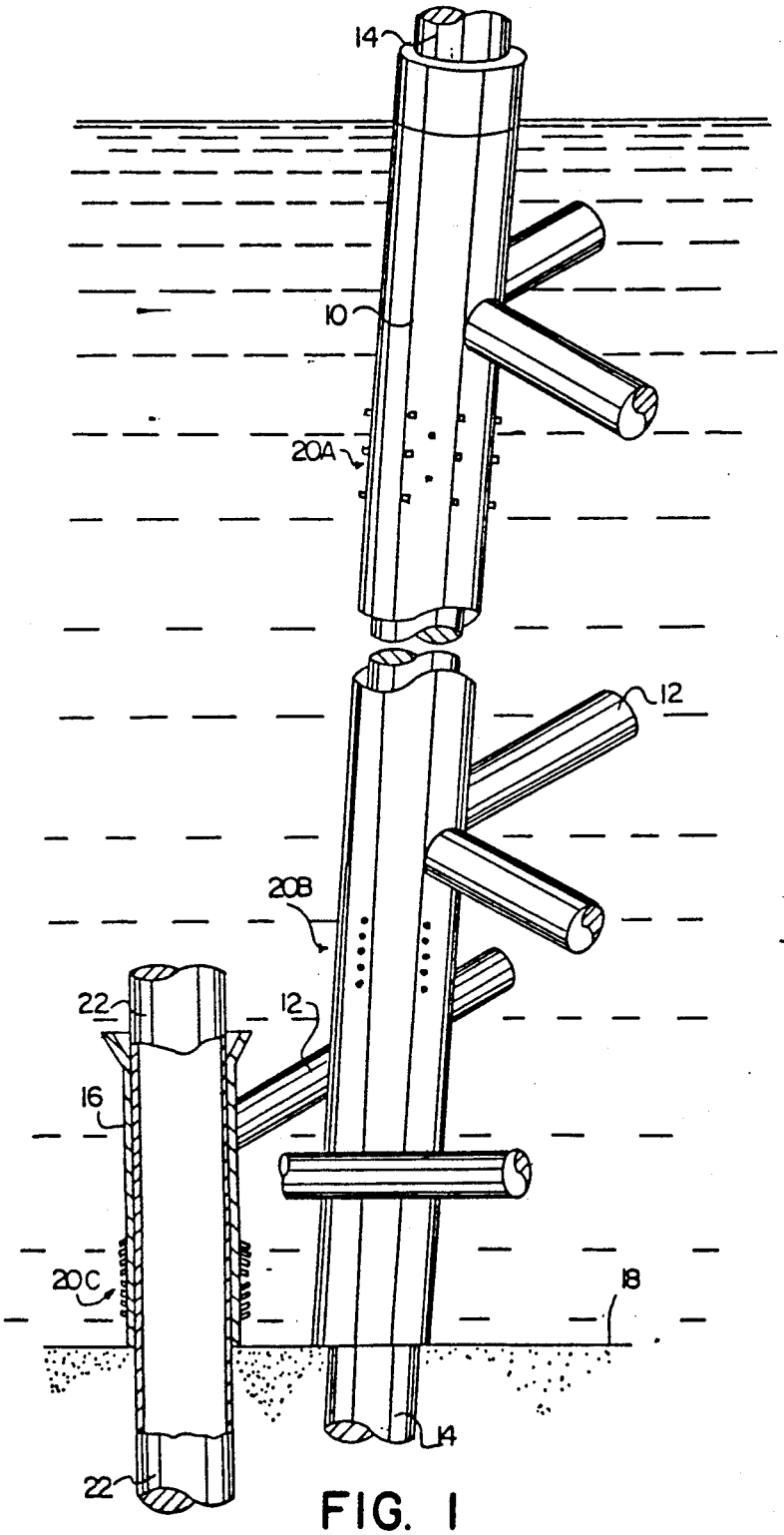
FIG. 1 is a simplified pictorial view, partially in cross section, of a portion of a subsea petroleum recovery platform positioned over a main piling and a satellite piling.

Referring now to FIG. 1, a main jacket leg 10 and a satellite jacket leg 16 of a conventional subsea petroleum recovery platform are generally depicted. The platform may include at least three or more substantially vertical main legs 10 which are generally inclined to increase structural integrity, and a plurality of substantially vertical satellite jacket legs 16 generally positioned about the main jacket legs 10. Main jacket legs 10 and satellite jacket legs 16 are typically connected by welding techniques or by bolted flanges.

With the platform resting on the floor of the ocean, main pilings 14 are lowered in telescoping fashion within the respective legs 10. Satellite pilings 22 ma be installed through satellite jacket legs 16. Each of the pilings 14 and 22 are then pounded into the soil underlying the body of water, shown as sea bed 18, for forming the foundation of the offshore structure. In their final position, the lower end of the main pilings 14 generally extend into the sea bed, and the upper end of pilings 14 extend above the surface of the water. Decking (not shown) may be placed over the main pilings. Satellite pilings 22 typically extend upward from the sea bed to a point slightly above leg 16. The platform thus acts as a template to interconnect the various main pilings 10 and satellite pilings 22 so that the significant forces acting between the pilings and the platform can be more uniformly distributed.

The present invention includes gripping members and piston assemblies as will be discussed in greater detail. The piston assemblies are typically arranged in rows, columns, or other selected configurations about the perimeter of main jacket legs 10 or jacket legs 16. As shown in FIG. 1, a staggered row arrangement 20A of piston assemblies is shown for securing main jacket leg 10 to piling 14. Rows of vertically aligned piston assemblies are shown in arrangement 20B which also serve to secure main jacket leg 10 to piling 14. An arrangement 20C of the piston assemblies is depicted in FIG. 1 for connecting satellite piling 22 and satellite jacket leg 16. It should be understood that the number and arrangement of the piston assemblies will depend upon the particular conditions of each offshore installation. For example, one installation may include four axially spaced columns of piston assemblies with from four to thirty piston assemblies in each column. In another typical installation, three axially spaced columns of piston assemblies may be used for connecting main jacket leg 10 to main piling 14, with two similar additional columns of piston assemblies for connecting adjacent satellite pilings 22 to jacket leg 16. Thus, the axial spacing of the piston assemblies along jacket leg 10, and the number and spacing of the piston assemblies, will depend upon the anticipated or assumed forces to be transmitted between jacket leg 10 and piling 14. This determination is preferably made prior to lowering the platform to the sea bed since, as explained subsequently, each of the piston assemblies is connected to the structure at a preselected angle.

Figure 2:
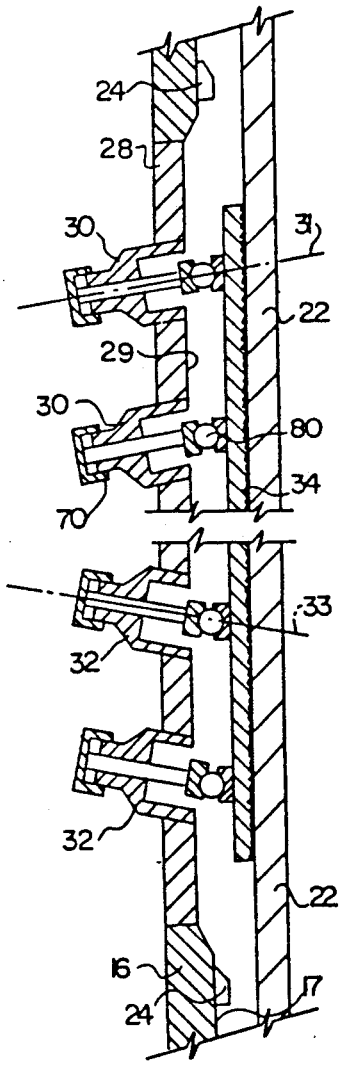
FIG. 2 is a cross sectional view of a portion of the satellite piling and interconnected platform jacket leg shown in FIG. 1.

A portion of a suitable connector according to the present invention is shown in greater detail in FIG. 2. As shown, leg can 28 is rigidly connected between a lower section of leg 16 and an upper section of leg 16. Inner surface 29 of leg can 28 is recessed from the inner surface 17 of leg sections 16 as will be more thoroughly described below. As shown, satellite jacket leg 16 is connected with tubular piling 22 by a plurality of upwardly inclined piston assemblies 30. Each piston assembly 30 is welded or otherwise secured to sleeve-shaped leg can 28. Each piston assembly 30 exerts a substantial radial inward force on the elongate, arcuately shaped gripping member 34, which is shown in FIG. 2 in engagement with the outer exterior surface of piling 22. Piston assemblies 32 are similarly connected to leg can 28 to exert a downward force on gripping member 34. A plurality of piston assemblies 30 may thus be arranged circumferentially about jacket leg 16 in substantially horizontal rows, and several rows of piston assemblies 30 may be provided within leg can 28. Similarly, numerous downwardly projecting piston assemblies 32 are arranged in rows and columns about leg can 28.

Sleeve-shaped can 28 is preferably metallic and is weldably secured to upper and lower sections of conventional jacket leg 16. As previously noted, the cylindrical inner surface 29 of leg can 28 has a radius greater than the radius of the internal surface 17 of jacket leg section 16. Preferably, this radius difference is equal to or greater than the thickness of the gripping member 34. When gripping member 34 is in a retracted position at a distance from piling 22, it is in engagement with inner surface 29 and does not extend radially outward beyond surface 17 toward piling 22. When gripping member 34 is in this fully retracted position, piling 22 will not contact gripping member 34 while piling 22 is inserted into leg 16. As an additional precaution, guides 24 are weldably secured to leg 16 to ensure that each piling 22 can safely pass through leg 16 and can be driven into sea bed 18 without damaging retracted gripping members 34. The outer cylindrical surface of leg can 28 may have a diameter identical to the diameter of the outer surface of leg 6, as shown in FIG. 2. If additional structural strength for leg can 28 is desired, the thickness of leg can 28 may be increased so that its outer surface extends beyond the outer surface of leg 16.

Significant loading forces directed along the axis of jacket leg 16 are typically transmitted between the jacket leg 16 and the piling 22. Those forces include, for example, much of the weight of the offshore platform and equipment normally located thereon for petroleum recovery operations. Accordingly to the present invention, each of the plurality of the piston assemblies 0 is inclined upwardly, so that the central axis 31 of each piston assembly 30 passes through or closely adjacent to the central axis of can 28 (and thus approximately the central axis of the leg 16) but is inclined at an angle of, for example, ten degrees from a radial plane perpendicular to the central axis of the can. Similarly, a central axis 33 of each of a plurality of downwardly projecting piston assemblies 32 passes through the axis of the can 28, and is inclined downwardly from the radial plane at a ten degree angle. This inclination of axis 31 and axis 33 would thus be ten degrees from the horizontal if the axis of jacket leg 16 were vertical. As shown in FIGS. 1 and 2, leg 10 is frequently inclined to increase the stability of the platform.

This feature of the present invention allows the combination of piston assemblies 30 and 32 to reliably transmit a substantial axially-directed loading force between the leg 16 and piling 22 in either the upward or downward directions. The upwardly inclined piston assemblies 30 are thus inclined at a preselected angle to transmit an axially directed upward force from leg 16 to piling 22 (or similarly to transmit an axially-directed downward force from the piling 22 to leg 16). On the other hand, downwardly inclined piston assemblies 30 are each inclined at a predetermined angle to transmit an axially-directed downward force from leg 16 to piling 22. Thus, while the preselected inclined angle of each of piston assemblies 30 and 32 will depend upon the particular conditions of the offshore installation, it is a feature of the present invention that a plurality of upwardly inclined and a plurality of downwardly inclined piston assemblies may be simultaneously used. By selectively positioning the piston assemblies, various loading forces may be transmitted between the piling and the leg. These loading forces may comprise static or dynamic axial, radial, and rotational forces.

In a preferred embodiment, the connector includes an arcuately shaped elongate gripping member 34 which is held in secured engagement to piling 22 by a plurality of piston assemblies 30 and 32. As shown in FIG. 2, each of the plurality of upwardly inclined piston assemblies 30 and each of the downwardly inclined piston assemblies 32 act upon the same gripping member 34. By providing elongate gripping member 34 for cooperation with numerous piston assemblies 30 and 32 within leg can 28, substantially uniform forces can be applied to a greater portion of piling 22 than would occur if each piston assembly 30 or 32 was provided with a separate gripping member 34. In addition, the use of a large gripping member 34 reduces problems associated with interference between multiple gripping members.

FIG. 2 also depicts a joint 80 between piston assembly 30 and gripping member 34. As illustrated, a separate joint is connected between gripping member 34 and each piston assembly 30 or 32. Joint 80 ensures that pressure will be applied to the gripping member 34 by each piston assembly 30 or 32 regardless of the inclination, angle, or offset of piston assembly 30 or 32. Joint 80 can be described as an adjustable pivot, a universal joint, or any other device which permits rotational movement between the piston assembly and gripping member 34. If a planar face of piston assembly 30 or 32 was fixed with respect to the axis of the piston assembly at an inclination equal to the predetermined angle selected for fixing piston assembly 30 or 32 to leg can 28, the piston assembly could apply an equal force to gripping member 34 provided that piling 22 and leg can 28 were concentric. Nevertheless, a universal joint in each piston assembly 30 or 32 uniquely ensures an efficient engagement of gripping member 34 with piling 22. Otherwise, a slight variation in the angle of piston assembly 30 or 32 would result in uneven distribution of forces on piling 22.

Figure 3:
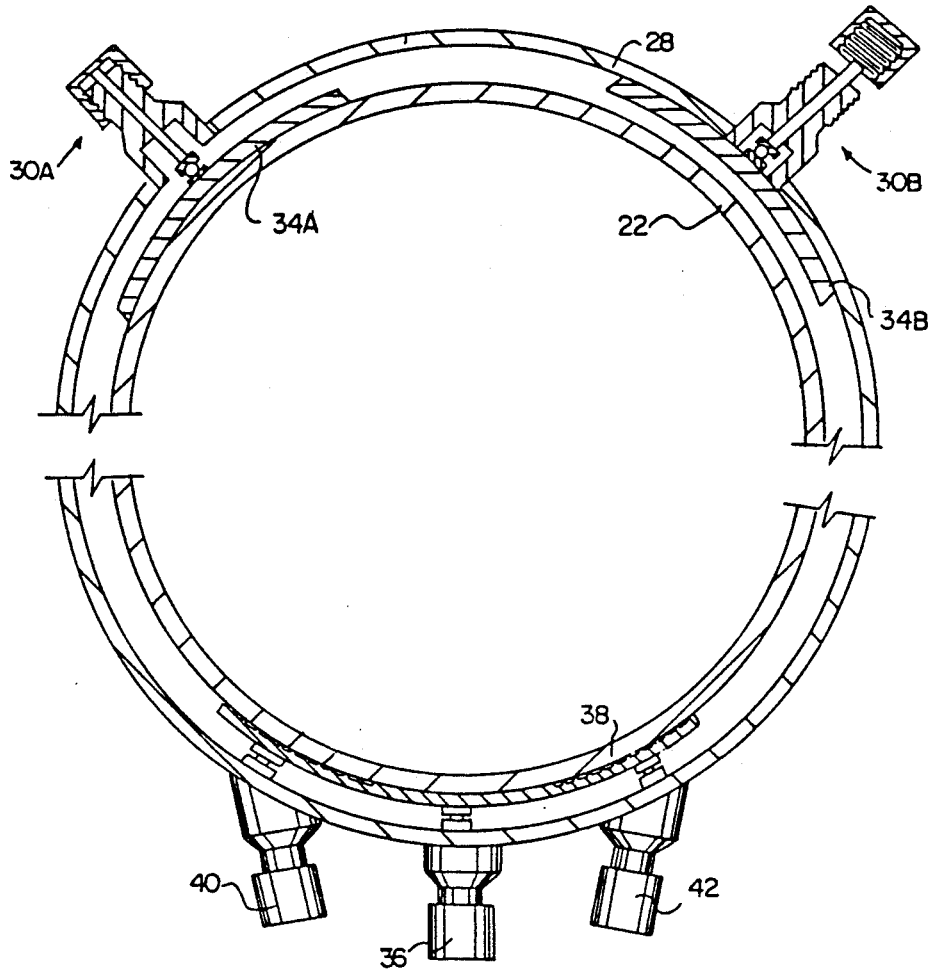
FIG. 3 is a cross sectional view of a platform jacket leg and piling which illustrates the circumferentially spaced arrangement of the gripping members.

Referring to FIG. 3, arcuately shaped gripping members 34A and 34B are shown. It should be understood that two or more gripping members will preferably be provided within leg can 28, with the gripping members being uniformly spaced about the perimeter of can 28. In one embodiment, the center line of gripping members 34A and 34B are spaced at an angle of approximately 90 degrees, and four substantially identical gripping members may be spaced about the perimeter of can 28. Piston assembly 30A is shown in its extended position so that gripping member 34A is in engagement with piling 22. Piston assembly 34B is depicted in its retracted position, so that gripping member 34B is out of engagement with piling 22. Piston assembly 34B is retracted within the annulus defined by the inner surface of can 28 and the inner surface of leg sections 16 (not shown).

FIG. 3 also depicts another gripping member 38 held in engagement with piling 22 by piston assemblies 36, 40 and 42. Piston assemblies 36, 40 and 42 may be axially spaced from piston assemblies 34A and 34B and may be positioned below assemblies 30A and 30B. Although not shown in FIG. 3, it should also be understood that an opposite gripping member and corresponding number of piston assemblies are preferably provided radially opposite gripping member 38 so that uniform gripping of piling 22 is obtained. A substantial radial force applied to piling 22 by each of the piston assemblies is preferably resisted by a radial oppositely positioned gripping member subjected to the same radial force and positioned on the radially opposite side of can 28, or by a pair of gripping members which together produce a radial force in the opposite direction.

The central axis of piston assembly 36 passes through and is perpendicular to the axis of leg can 28, and piston assembly 36 exerts a purely radially directed force on piling 22. Thus while piston assemblies 30 and 32 exert a force on the piling with a substantial radial component plus an axially directed component as shown in FIG. 2, and are thus provided for transmitting an axially directed force between the leg 16 and piling 22, piston assembly 36 transmits a substantially horizontal or radial force between these components.

The central axis of piston assembly 40 is inclined outwardly with the axis of piston assembly 36 and is spaced therefrom so that the axis of piston assembly 40 is substantially spaced from the axis of the leg can 28. Piston assembly 40 is provided to transmit a counterclockwise rotational force to leg can 28 from piling 22, or to transmit a clockwise rotational force to piling 22 from leg can 28. The central axis of piston assembly 42 is similarly inclined outwardly with respect to the central axis of piston assembly 36, and is spaced from and on the opposite side of the central axis of leg can 28. Thus piston assembly 42 is provided for reliably transmitting a clockwise rotational force to leg can 28 from piling 22, or a counterclockwise force from piling 22 to leg can 28.

Each of the piston assemblies 40 and 42 may also be angled with respect to the center line of the piston assembly 36 to vary the rotational force which may be reliably transmitted by that piston assembly. If piston assemblies 40 and 42 were angled inwardly so their central lines were closer to the axis of leg can 28, less rotational force could be transmitted through that piston assembly. This arrangement would facilitate attachment of the piston assembly to leg can 28 and would reduce manufacturing costs. If piston assemblies 40 and 42 were angled further outwardly from the center line of the leg can, more rotational force between the piling 22 and the leg 28 could be reliably transmitted by the piston assemblies. FIG. 3 also depicts that the joint of each piston assembly permits the force to be applied to the gripping member, regardless of the offset or angle of piston assemblies 40 and 42.

It should thus be understood that each leg of the platform may include one or more leg cans, each having a plurality of arcuate shaped gripping members spaced circumferentially about the leg can, and a multiplicity of piston assemblies for bringing the gripping members into secured engagement with the piling. In one embodiment, a first plurality of the piston assemblies are fixed to a leg can at a preselected upwardly inclined angle and a second plurality of piston assemblies are fixed to the leg can at a downwardly inclined angle. Each of the piston assemblies will exert a substantial radial force on the piling. In addition, each piston assembly will transmit a substantially axially directed force between the platform leg and the piling, thereby preventing undesirable vertical movement of the platform.

In addition to the embodiments disclosed above, each platform leg can may also be provided with a third plurality of piston assemblies, with the axis of each piston assembly being spaced on one side of the axis of the leg can for transmitting a clockwise rotational force between the platform leg and the piling. A fourth plurality of piston assemblies, each having its axis spaced on the other side of the central axis leg can, may transmit a counterclockwise rotational force between the platform leg and the piling. These groups of piston assemblies prevent rotational movement between the platform leg and the piling. Finally, the same or another leg can may be provided with a fifth plurality of piston assemblies wherein each piston assembly has an axis passing through and being substantially perpendicular to the axis of the leg can for transmitting primarily a horizontal or radial force between these components.

The function of two or more of the piston assemblies described above may be combined. For example, an upwardly inclined piston assembly which also has its axis spaced from the center line of the leg can could achieve the benefits of one of the first and one of the third plurality of piston assemblies, while another downwardly inclined piston assembly having its axis spaced on the opposite side of the leg can could function in a manner similar to one of the second of the fourth piston assemblies. Preferably, it is a feature of the present invention that each of the piston assemblies selectively transmit a force between the platform leg and the piling along one principal vectorial component. Most importantly, the piston assemblies are not provided at a mere random orientation about the periphery of the platform leg, but rather are each fixed to the leg can at a preselected angle for cooperating with other piston assemblies to transmit an assumed force in a certain vectorial direction between the platform leg and the piling.

Figure 4:
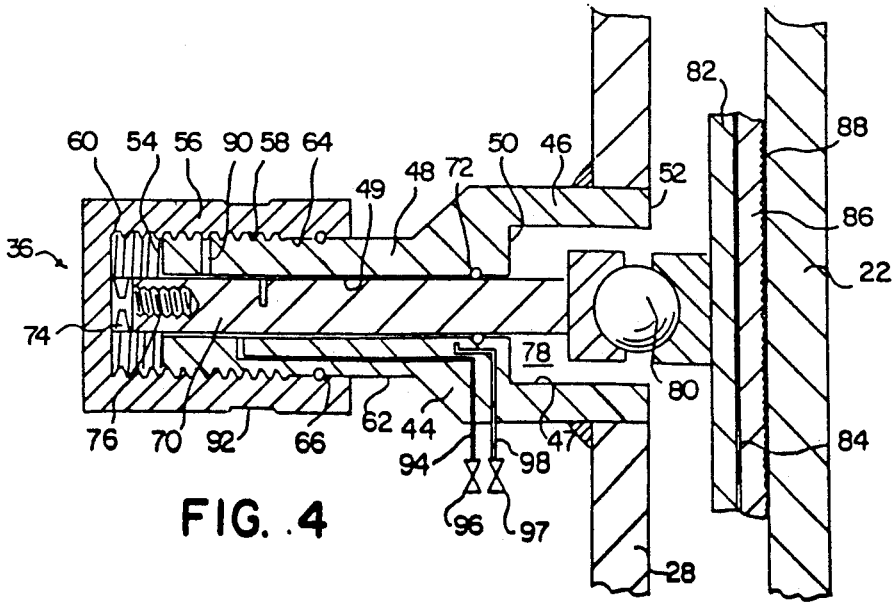
FIG. 4 is a detailed cross sectional view of a piston assembly, joint, and gripping member in engagement with a piling.

The details of one embodiment of piston assembly 36 are shown in FIG. 4. Although a vast majority of the piston assemblies in leg can 28 do not have their axes perpendicular to and passing through the center line of the leg can, each of the piston assemblies are substantially identical to that depicted in FIG. 4. Housing 44 of the piston assembly is connected to leg can 28 and may be adapted to accommodate inclined, angled, or an offset orientation of each piston assembly. Housing 44 has a reinforced end 46 for weldably securing housing 44 to leg can 28, and a distal, or free end 48 is located away from leg can 28. Cylindrical passageway 49 in free end 48 is adapted for slidably receiving piston 70, while a cylindrical passageway 47 in end 46 receives the cylindrical-shaped joint 80. A stop surface 50 between passageways 47 and 49 acts to limit retraction of piston 70 into housing 44. End surface 52 of housing 44 does not extend radially inward of the inner surface of the leg can 28, so that gripping member 81 contacts leg can 28 when gripping member 81 is fully retracted.

Piston assembly 36 can comprise many different configurations. Fundamentally, piston assembly 36 acts as a drive means to urge gripping member into engagement with the piling. Piston assembly 36 can comprise any adjustable mechanism which is capable of performing this function. For example, the drive means could include or could be connected to an adjustable slip joint.

Free end 48 of housing 44 is threaded so that end cap 56 may be attached thereto by threads 58 The planar surface 60 of end cap 56 is in engagement with tapered bearing assembly 74 which is removably secured to the end of piston 70. Torqued rotation of end cap 56 relative to the housing 44 thus acts through bearing assembly 74 to produce a substantial force along the central axis of piston assembly 36 to drive piston 70 inward. This movement causes gripping member 81 to engage piling 22. Threads 78 may be coated with Teflon or other suitable material to reduce friction between end cap 56 and housing 44. Low friction between end cap 56 and piston 70 is obtained by utilizing bearing assembly 74, which allows end cap 56 to freely rotate, while movement of piston 70 is limited by housing 44 to the direction along the central axis of piston 70.

During installation, the platform leg and leg can 28 may be eccentrically located about the piling 22. In order to allow for variations in the thickness in the annulus between the piling and the platform leg, it is apparent from FIG. 4 that the planar surface 60 of end cap 56 is normally substantially spaced from end 54 of housing 44, although gripping member 81 is shown in engagement with the piling 22. For this reason, the separation between surfaces 60 and 54 would permit continued torqued rotation of end cap 56 relative to housing 44 sufficient to bring gripping member 81 into engagement with piling 22. This engagement is possible even if piling 22 contacted the inner surface of the leg can 28 at a position opposite piston assembly 36.

With end cap 56 threaded onto housing 44, the end of piston 44 opposite the universal joint 80 may be sealed from the environment by seals 66 and 72. Seal 66 maintains sealed engagement between the cylindrical inner surface 64 of end cap 56 and the cylindrical outer surface 62 of the housing regardless of the threaded position of end cap 56 on housing 44. Seal 72 maintains sealed engagement between the cylindrical inner surface 49 of housing 44 and the outer cylindrical surface of piston 70.

Hydraulic pressure may also be used to move gripping member 1 into engagement with piling 22. If valve 96 is opened, fluid pressure may be applied to the piston through flow line 94 in housing 44. Since the opposite end of the piston assembly is subjected to the constant force of sea water pressure, increased fluid pressure in the line 94 will drive the piston inwardly. Fluid may be circulated through piston assembly 36 during this process by passing out discharge line 98 which is regulated by flow valve 97. Shear pin 90 retains the gripping member in the retracted position while piling 22 is installed through leg can 28.

In a preferred embodiment, joint 80 is provided with a large diameter ball; a 360° joint (FIG. 4), for transmission of high forces. Joint 80 extends radially outwardly from piston 70 with respect to the piston axis. Nevertheless, joint 80 has a diameter substantially less than the diameter of cylindrical surface 47, since it is intended that joint 80 be retractable into cavity 78 even if joint 80 becomes locked or frozen in an inclined or angled position.

Gripping member 81 is shown in greater detail in FIG. 4. Gripping member 81 preferably includes a metallic arcuate-shaped outer member 82 connected to joint 80, a metallic arcuate-shaped inner member 86 having projections 88 thereon for biting engagement with piling 22, and a thin plastic layer 84 sandwiched between members 82 and 86. Layer 84, which may be a laminated elastomeric material formed either on members 82 or 86, provides some resiliency between the elements of gripping member 81 so that projections 88 grip piling 22 even when piling 22 is not perfectly cylindrical, or when the diameter of piling 22 does not conform exactly to the arcuate shape of inner member 86. Thus, while joint 80 ensures that a planar force will always be applied to gripping member 81 by piston assembly 36 regardless of its inclination, angle or offset, elastomeric layer 84 is provided to better enable the arcuate inner member 86 to flex so that projections 88 will engage piling 22.

Figure 5:
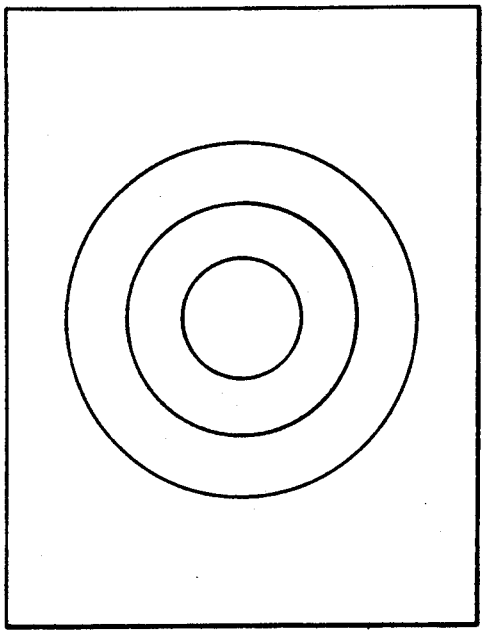
FIGS. 5 through 7 show different patterns of projections.
Figure 6:
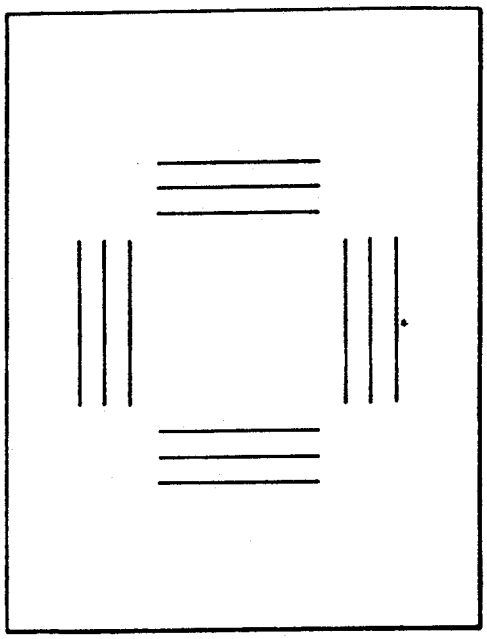
Figure 7:
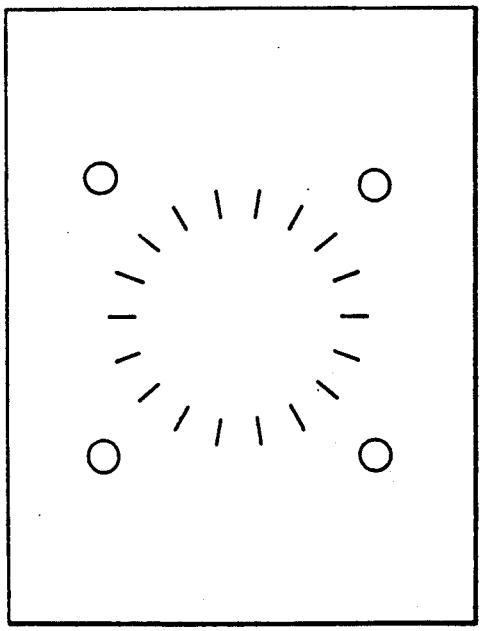

As previously set forth, the surface of the gripping member will preferably have projections which assist in the transmission of the vectorial force between the platform leg and piling 22. Preferably, the projections will be angled in the direction of the force exerted by the piston assembly. As gripping member 34 is urged into piling 22 by upwardly inclined piston assemblies 30, as shown in FIG. 2, upwardly inclined rows of projections grip piling 22. For downwardly inclined piston assemblies 32, downwardly inclined projections serve a similar function. As illustrated in FIG. 3, the portion of gripping member 38 adjacent piston assembly 40 will preferably include vertical columns of projections 89 angled in a direction clockwise with respect to the central axis of piling 22, while that portion of the gripping member adjacent piston assembly 42 will preferably include columns of projections 91 angled in the opposite radial direction. In other embodiments of the invention, various patterns of projections, including projections which point in different directions, can be used to increase the gripping effectiveness of the gripping member against the piling. For example, the projections could be shaped as concentric rings, or as radial spokes centered about the middle of the face of the gripping member. In other embodiments, the projections could be fashioned in columns parallel to each side of a substantially rectangular gripping member. Examples of several patterns of projections are illustrated in FIGS. 5–7. It is apparent that various configurations of projections can be used without departing from the scope of the invention.

According to the method of the present invention, a preselected number of leg cans may be provided at selected intervals along the length of the main platform legs or the satellite legs. Each leg can may include a plurality of gripping members and a plurality of piston assemblies, as described herein, so that the piston assemblies are fixed to each leg can at a preselected angle for transmitting the loading forces between the platform leg and the piling. Piston assemblies can be arranged in rows and columns about the leg can or can be placed in other selected configurations. The leg can may be axially spaced adjacent a cross brace, such as brace 12 shown in FIG. 1, to increase structural integrity.

To install the platform, the platform is lowered to rest on the soil of the sea floor 18. Initially, the piston assemblies and the gripping members are in their retracted position. The gripping members are preferably retained within the annulus of the leg can and do not extend radially inward of the adjacent platform leg interior surfaces. Accordingly, the piling may be lowered through the leg without contacting the gripping members and can be driven into the soil by conventional techniques.

Once the pilings have been driven into the soil, a diver, robot, or other conventional means may be utilized to rotate end cap 56. As end cap 56 is rotated, drive the gripping members into engagement with the pilings. Each piston may be sequentially or simultaneously moved so that the gripping members center the piling within the leg can as the gripping members engage the piling. To facilitate the operation of end cap 56, each end cap 56 may have planar sides 92 for receiving a conventional tool.

Each of the piston assemblies within the leg can may alternatively be actuated to move the gripping members into engagement with piling 22 by supplying a hydraulic pressure to each of the piston assemblies through flow lines 94 and 98. According to one technique, fluid pressure applied to each of the piston assemblies is used to bring and maintain the gripping members into secured engagement with the piling, thereby obviating the need for end cap 56. According to another method, fluid pressure is utilized to bring the gripping members uniformly into engagement with the piling, and end cap 56 is then rotated to maintain the necessary pressure on piston 70. In this later case, hydraulic fluid is vented through line 98 as end cap 56 is rotated into engagement with piston 70.

The plurality of circumferentially spaced arcuate gripping members and piston assemblies of the present invention also allow the platform leg to be concentrically positioned about the piling. For example, if three circumferentially spaced gripping members A, B, and C are positioned at the 2:00, 6:00 and 10:00 positions, respectively, and it is known or presumed that the annulus between the piling and the platform leg is more restricted at the 2:00 position, the piston assemblies associated with gripping member A may first be partially extended so that the vertical axes of the piling and platform leg move closer together. Thereafter, each of the piston assemblies is sequentially activated until the end caps have been sufficiently torqued. In this fashion, the uniformity of the annulus between the piling and the platform leg can be controlled.

It may be desirable during the life of the offshore platform to disconnect and reconnect one or more pilings. This may be accomplished by unthreading each end cap and by manipulating the pistons to retract the gripping member away from piling 22. The gripping members are preferably retracted until they contact the leg can 28. In the event that the pistons should become corroded or otherwise lodged in the locked position, the end caps may be completely removed, the bearing assemblies removed from the end of the pistons, and a conventional tool inserted into the threaded cavities of the piston. An extracting force may be easily applied to the tool in conventional manner to pull the pistons and the gripping members to the retracted position.

After the useful life of the offshore platform has been exhausted, it is generally desirable to retrieve the platform. Accordingly to the present invention, the platform may be retrieved by cutting the pilings below the mud line. Next, the gripping members are retracted from engagement with the pilings so that the severed pilings may be pulled to the surface through the platform legs. With the weight of the pilings off the platform, the platform may then be floated to the surface using conventional technology. As shown by this method, the platform can thus be easily salvaged and can be reused at another site. The economic usefulness of this method is apparent.

Those skilled in the art would appreciate that various modifications can be made without departing from the spirit of the invention. It is apparent that many configurations of drive mechanisms can be utilized to urge the gripping members into engagement with the pilings. For example, a piston-like member similar to the vertical support of a conventional automobile jack may be utilized for applying force to the gripping member, so that the piston is jacked radially inward by the repeated engagement and disengagement of the latch dogs. In other embodiments, an adjustable slip joint and a pivot could be incorporated in the drive mechanism to adjust for movement between the drive mechanism and the gripping member. The pilings need not be tubular in shape, and the gripping members may be formed in many different configurations to engage the pilings. The piling may be reinforced at the point of engagement with the gripping members to reduce the possibility that the pilings might collapse.

In other embodiments of the invention, the gripping members can connect other types of structures to a piling. For example, structures ancillary to an offshore platform such as a support leg or pipeline, can be connected to the drive means, gripping member, and piling. Other embodiments contemplate the application of the present invention to any environment where it is desirable to releasably connect a structure to an elongate member such as a piling. For example, the invention is applicable to various constructions or installations, above the water or below, which have a need for a releasable connection.

Because many varying and different embodiments may be made within the scope of the inventive concept herein taught, and because many modifications may be made in the embodiments herein detailed, it is to be understood that the details herein are to be interpreted as illustrative and not in a limiting sense.

What is claimed is:

1. An apparatus for releasably connecting a structure to a piling, comprising:

a gripping member for releasably engaging the piling;

a joint connected to said gripping member, said joint operable to orient said gripping member vertically and horizontally with respect to the piling, whereby vertical and rotational reaction force are transmitted from the piling to the structure; and drive means connected between the structure and said joint for urging said gripping member into engagement with the piling and for selectively withdrawing said gripping member from engagement with the piling.

2. An apparatus as recited is claim 1, wherein said gripping member comprising a metallic plate.

3. An apparatus as recited in claim 2, wherein said gripping member comprises a metallic inner plate, a metallic outer plate, and an elastomer bonded between said inner plate and said outer plate.

4. An apparatus as recited in claim 2, wherein the gripping surface of said gripping member which engages said piling includes projections for engaging said piling.

5. An apparatus as recited in claim 1, wherein said joint is a ball joint.

6. An apparatus as recited in claim 1, wherein said joint is a telescoping joint.

7. An apparatus as recited in claim 1, wherein at least two drive means and corresponding joints are connected between the subsea structure and said gripping member.

8. An apparatus as recited in claim 1, wherein said drive means is positioned to transmit loading forces between the structure and the piling.

9. An apparatus as recited in claim 1, wherein said drive means comprises a drive shaft having a first end rotatably connected to said joint, a second end in sliding engagement with the subsea structure, and a means engaged with said shaft for urging said gripping member into engagement with said piling and for selectively withdrawing said gripping member from engagement with the piling.

10. An apparatus for releasably connecting a structure to a substantial vertical, cylindrical piling having one end anchored to the soil underlying a body of water, comprising:

an arcuate gripping member having an elongated face for releasably engaging the piling;

a joint connected to said gripping member, said joint operable to orient said gripping member vertically and horizontally with respect to the piling, whereby vertical and rotational reaction forces are transmitted from the piling to the structure;

a housing formed in the structure; and a drive means connected between said joint and said structure for urging said face of said gripping member into engagement with the piling and for selectively withdrawing said gripping member from engagement with the piling, wherein said drive means is positioned within said housing.

11. An apparatus as recited in claim 10, wherein said gripping member comprises a metal plate.

12. An apparatus as recited in claim 11, wherein the gripping surface of said gripping member includes projections for engaging the outer surface of the cylindrical piling.

13. An apparatus as recited in claim 10, wherein said joint is a ball joint.

14. An apparatus as recited in claim 10, wherein said joint is a telescoping joint.

15. An apparatus as recited in claim 10, wherein said drive means is positioned to transmit loading forces between the structure and the piling.

16. An apparatus for releasably connecting a tubular leg of a structure to a substantial vertical, cylindrical piling having a lower end anchored to the soil underlying a body of water, comprising:

at least two arcuate gripping members, each member having a vertically elongated, arcuately extended face, for long term releasably engaging the piling;

at least one joint connected to each of said gripping members, said joint operable to orient said gripping member vertically and horizontally with respect to the piling, whereby vertical and rotational reaction forces are transmitted from the piling to the structure;

a drive means connected between each joint and the structure, wherein said drive means are positioned to urge said face of said gripping members into engagement with the piling so that the longitudinal axis of the piling substantially coincides with the longitudinal axis of the tubular leg of the structure.

17. An apparatus as recited in claim 16, wherein said drive means are positioned to restrict concentric rotational movement of the tubular leg relative to the piling.

18. An apparatus as recited in claim 16, wherein said drive means are positioned to transmit loading forces between the tubular leg and the piling.

19. An apparatus as recited in claim 16, wherein said drive means includes a rotatable end cap for selectively engaging and disengaging each of said gripping members with the piling.

20. An apparatus for releasably connecting a tubular leg of a structure to a substantially vertical, cylindrical piling having a lower end anchored to the soil underlying a body of water, wherein the tubular leg has an upper section and lower section, and wherein the inner diameter of the tubular leg exceeds the outer diameter of the piling, comprising:

a substantially cylindrical leg section connected between the upper section and the lower section of the tubular leg, wherein the interior diameter of said leg section exceeds the interior diameter of the upper section and of the lower section of the tubular leg to create a small annulus axially located between the inner surface of the leg section and the interior surfaces of the upper and lower section of the tubular leg;

at least one arcuate gripping member for releasably engaging the piling;

a 360° joint connected to each of said gripping members, said joint operable to orient said gripping member vertically and horizontally with respect to the piling, whereby vertical and rotational reaction forces are transmitted from the piling to the structure; and a drive means connected between each of said joints and said leg section, wherein each of said drive means is capable of urging the corresponding gripping means into engagement with said piling, and wherein each of said drive means capable of selectively withdrawing said gripping means from engagement with the piling and into said annulus adjacent the inner surface of said leg section.

21. An apparatus as recited in claim 20, wherein said drive means includes a piston assembly having a longitudinal axis which intersects with the outer surface of the piling.

22. An apparatus as recited in claim 21, wherein the angle between the longitudinal axis of said piston assembly and the axis of the piling is less than ninety degrees.

23. An apparatus as recited in claim 22, wherein the engagement of said gripping member with the piling, together with said joint and said drive means, transmits loading forces between the piling and the tubular leg.

24. An apparatus as recited in claim 23, further comprising a gripping member, joint, and connected drive means which are positioned to transmit loading forces between the piling and the tubular leg which vectorially oppose the loading forces transmitted by said first drive means, joint, and gripping member.

25. An apparatus as recited in claim 24, wherein said drive means and connected joint and gripping member restricts concentric rotational movement of the structure about the piling.

26. A method of releasably connecting a structure connected to a submerged tubular leg to a piling, comprising the steps of:

positioning the piling in the water adjacent to the structure interior to the submerged tubular leg; and manipulating a drive means, connected to the structure, to urge a gripping member into vertical and horizontal engagement with the piling.

27. A method as recited in claim 26, further comprising the step of maintaining the gripping member in engagement with the piling.

28. A method as recited in claim 26, further comprising the step of manipulating at least two drives connected to the structure and to the gripping member to urge the gripping member into engagement with the piling.

29. A method as recited in claim 26, further comprising the step of manipulating a secondary drive means connected to the structure and a secondary gripping member to urge the secondary gripping member into engagement with the piling.

30. A method as recited in claim 27, further comprising the step of severing the piling at a point below the gripping member.

31. A method as recited in claim 30, further comprising the step of retracting said gripping member from engagement with the piling.

32. A method as recited in claim 31, further comprising the step of withdrawing the piling from the position adjacent to the structure.

33. A method as recited in claim 32, further comprising the step of recovering the structure.

34. A method of releasably connecting an offshore submerged hollow leg to a tubular piling, comprising the steps of:

installing the tubular piling into the soil underlying the structure at a position interior to and adjacent to the hollow leg;

manipulating a first drive means, connected to the hollow leg, to urge a first gripping member into contact with the piling;

manipulating a second drive means, connected to the hollow leg, to urge a second gripping member into contact with the piling; and continuing to manipulate said first and second drive means until said first and second gripping members are in vertical and horizontal engagement with the piling.

35. A method as recited in claim 34, further comprising the step of manipulating a third drive means connected to the structure to urge said first gripping member against the piling.

36. A method as recited in claim 34, wherein the tubular piling is installed within a substantially tubular leg of the structure, and wherein said first and second drive means are selectively manipulated to move the longitudinal axis of the piling toward the longitudinal axis of the tubular leg.

37. A method as recited in claim 34, further comprising the step of maintaining said first and second gripping members in engagement with the piling.

38. A method as recited in claim 34, further comprising the step of severing the piling at a point below the gripping member.

39. A method as recited in claim 34, further comprising the step of manipulating said first and second drive means to selectively retract said first and second gripping member from engagement with the piling.

40. A method as recited in claim 39, further comprising the step of withdrawing the piling from the position adjacent to the structure.

41. A method as recited in claim 40, further comprising the step of recovering the structure.

42. An apparatus for releasably connecting a structure to a piling, comprising:

a gripping member for releasably engaging the piling;

a joint connected to said gripping member; and drive means connected between the structure and said joint for urging said gripping member into engagement with the piling and for selectively withdrawing said gripping member from engagement with the piling;

said drive means including hydraulic means for engaging said gripping member with the piling and mechanical means for overriding said hydraulic means and locking said gripping member against the piling.

* * * * *